United States Patent [19]

Gasser et al.

[11] 4,175,371

[45] Nov. 27, 1979

[54] BROKEN END-COLLECTING INSTALLATION AND METHOD OF OPERATING THE SAME

[75] Inventors: Hermann Gasser, Zürich; Karl Curiger, Pfaffikon, both of Switzerland

[73] Assignee: Luwa AG, Zürich, Switzerland

[21] Appl. No.: 888,754

[22] Filed: Mar. 21, 1978

[30] Foreign Application Priority Data

Mar. 28, 1977 [CH] Switzerland ..... 3864/77

[51] Int. Cl.[2] ..... D01H 5/68; D01H 11/00

[52] U.S. Cl. ..... 57/304; 19/263

[58] Field of Search ..... 57/34.5, 56, 156, 300, 57/304, 305; 19/262–265

[56] References Cited

U.S. PATENT DOCUMENTS

| | | | |
|---|---|---|---|
| 2,522,250 | 9/1950 | Bechtler | 57/34.5 |
| 3,073,105 | 1/1963 | Jacobi et al. | 57/34.5 |
| 3,813,865 | 6/1974 | Hohlach | 57/34.5 |
| 4,026,095 | 5/1977 | Kobatake et al. | 57/34.5 |

FOREIGN PATENT DOCUMENTS

| | | | |
|---|---|---|---|
| 1366770 | 12/1964 | France | 57/34.5 |
| 652311 | 4/1951 | United Kingdom | 57/34.5 |

*Primary Examiner*—John Petrakes

*Attorney, Agent, or Firm*—Werner W. Kleeman

[57] ABSTRACT

A yarn rupture-suction installation or broken end-collecting installation for the drafting systems or drafting gears of spinning machines, comprising a respective suction head for each drafting system connected with an air pressure sink and having a substantially slot-shaped suction opening associated with a delivery or feed roller of each drafting system. The suction opening extends from one end situated close to the spinning triangle to an end situated closer to an air pressure sink in the direction of flow of the air.

The method of operating such installation and for preventing clogging of the suction head thereof contemplates imparting to a ruptured yarn piece or broken end leading to the rupture location a different position than the path of travel of the fiber material which is further delivered to the drafting system.

20 Claims, 3 Drawing Figures

BROKEN END-COLLECTING INSTALLATION AND METHOD OF OPERATING THE SAME

BACKGROUND OF THE INVENTION

The present invention relates to a new and improved construction of a yarn rupture-suction installation, more conventionally termed broken end-collecting installation for the drafting systems or drafting arrangements of spinning machines, there being provided a respective suction head for each drafting system which is connected with an air pressure sink and having a substantially slot-shaped opening associated with the feed or delivery roller of the related drafting system. The invention further concerns a novel method of operating such installation to prevent clogging of the suction head.

In spinning machines it is already known for quite some time to equip the drafting systems or drafting gears with suction devices for ruptured yarn or the like, as such for instance has been disclosed in British Patent No. 951,209. The suction devices possess suction tubes or pipes which are connected at one end thereof with a suction channel which extends in the lengthwise direction of the machine below for instance the creel, whereas the other end of each such suction tube forms a suction opening. According to certain types of constructions of such equipment, a suction tube is provided for each drafting system, the suction opening of which, as a general rule, is disposed below the lower feed or delivery roller at the neighborhood of the yarn or thread path of travel extending to the spindle.

Apart from the foregoing, there is also already known to the art a device arranged at a ring spinning machine, wherein there is provided, apart from a suction opening associated with the lower feed roller of each drafting system, also a suction opening associated with the upper feed or delivery roller. Due to this arrangement it is intended that one end of the ruptured yarn or thread, which is not engaged by the suction opening of the lower feed roller, will be seized by the suction opening of the upper feed roller during ascent towards such upper feed roller.

The state-of-the-art yarn rupture-suction installations or broken end-collecting installations are not capable of satisfying the present-day requirements for a different reason. Upon occurrence of yarn or thread rupture, the thread or the like is usually engaged with adequate reliability. But, on the other hand, oftentimes there occurs shortly after engagement or seizing of the thread clogging of the suction tube at the neighborhood of the suction opening, producing the well-known undesirable consequences.

Examination of the cause of such clogging has shown that yarn or thread rupture at flyer-spinning machines occurs with relatively increasing frequency at the press or contact finger and yarn rupture at ring spinning machines often occurs directly at the travellers. Consequently, upon occurrence of yarn rupture there is engaged by the suction opening, not only fiber material which is delivered by the drafting system, but also such roving or yarn whose free end is retained at the flyer or in the case of a ring spinning machine, at the thread or yarn guide. The outflow of the further delivered fiber material through the suction opening therefore can be hindered by such yarn at the region of the suction opening. A further difficulty which is additionally present is that the twist present at such section of fiber material or formed by the operation of the specific machine, causes a curling of the yarn in the suction tube and a braiding of the fiber material which is further delivered by the drafting system.

SUMMARY OF THE INVENTION

Hence, with the foregoing in mind it is a primary object of the present invention to provide a new and improved construction of broken end-collecting installation which is not associated with the aforementioned drawbacks and limitations of the prior art proposals.

Another and more specific object of the present invention aims at the provision of a new and improved construction of broken end-collecting installation which is structured such that there is eliminated the danger of clogging at or in the suction tube, or thereby retarding the occurrence of clogging.

Still a further significant object of the present invention concerns a new and improved construction of broken end-collecting installation which is relatively simple in design, economical to manufacture, extremely reliable in operation, not readily subject to breakdown or malfunction, and requires a minimum of maintenance and servicing.

Now in order to implement these and still further objects of the invention, which will become more readily apparent as the description proceeds, the invention exploits the general inventive concepts of directing the yarn piece of section at the suction opening and leading to the rupture location towards a different place than the path of the fiber material which is further delivered by the drafting system. More specifically, the equipment of the invention is manifested by the features that the suction opening extends from one end situated closer to the spinning triangle towards an end situated closer to an air pressure sink in the flow direction of the air. If the suction head is connected with a suction tube or pipe, then the end of the suction opening which is located nearer to the air pressure sink advantageously protrudes into the axial projection of the suction tube.

The inventive design of the suction opening, upon occurrence of yarn rupture, has the effect that after seizing the yarn by the part coacting with the spinning triangle the yarn forms an open loop in the suction opening. The outgoing end, i.e., the part of the yarn possessing twist, experiences a shift, i.e. a displacement in the lengthwise direction of the suction slot, and specifically, under the action of the general flow direction in the suction head and particularly owing to the increase of the suction force towards the end of the suction opening situated more remote from the spinning triangle, as previously explained.

Consequently, the further delivered fiber material, sliver or roving, and the yarn leading to the rupture location, neither join one another at the suction opening nor directly behind such suction opening as looped parts. Quite to the contrary, the zone where the looped parts could join together for the first time, comes to lie in the interior of the related suction tube. However, the loop is broken up into fibers and fiber bunches by the air flow entering the suction tube by means of its end part, before clogging can occur.

To the extent that with yarn or thread rupture the free end is retained at the flyer, vane or at the yarn or thread guide of the ring spinning machine, the part of the relevant loop branch containing twist cannot sufficiently enter the interior of the suction tube in order to hinder the free outflow of the fiber material which is still delivered by the active drafting system. There is thus no clogging danger, even if the machine is not brought to standstill.

On the other hand, if yarn rupture occurs at a location between the spinning triangle and the flyer head or yarn guide, as the case may be, then the loop part possessing twist, to the extent present, likewise will be sucked into the suction tube. Since, however, as already explained, the loop parts first meet internally of the suction tube, there is at least retarded the occurrence of any actual clogging. It is therefore possible to stop the machine before this condition is reached.

According to a preferred manifestation of the broken end-collecting installation or apparatus of the invention, the suction opening is arranged such that its end situated closest to the spinning triangle also is disposed closer to the flyer head or yarn guide than the end which is more closely situated to the air pressure sink. This affords the beneficial result that the loop part which is connected with the retained free end, during its displacement into the suction opening in the air flow direction, cannot in any event penetrate more deeply into the end part. Due to the greater spacing to the flyer head or yarn guide there is in fact brought about withdrawal of a section of such loop part out of the suction opening during its displacement.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figures 1, 2, 3:
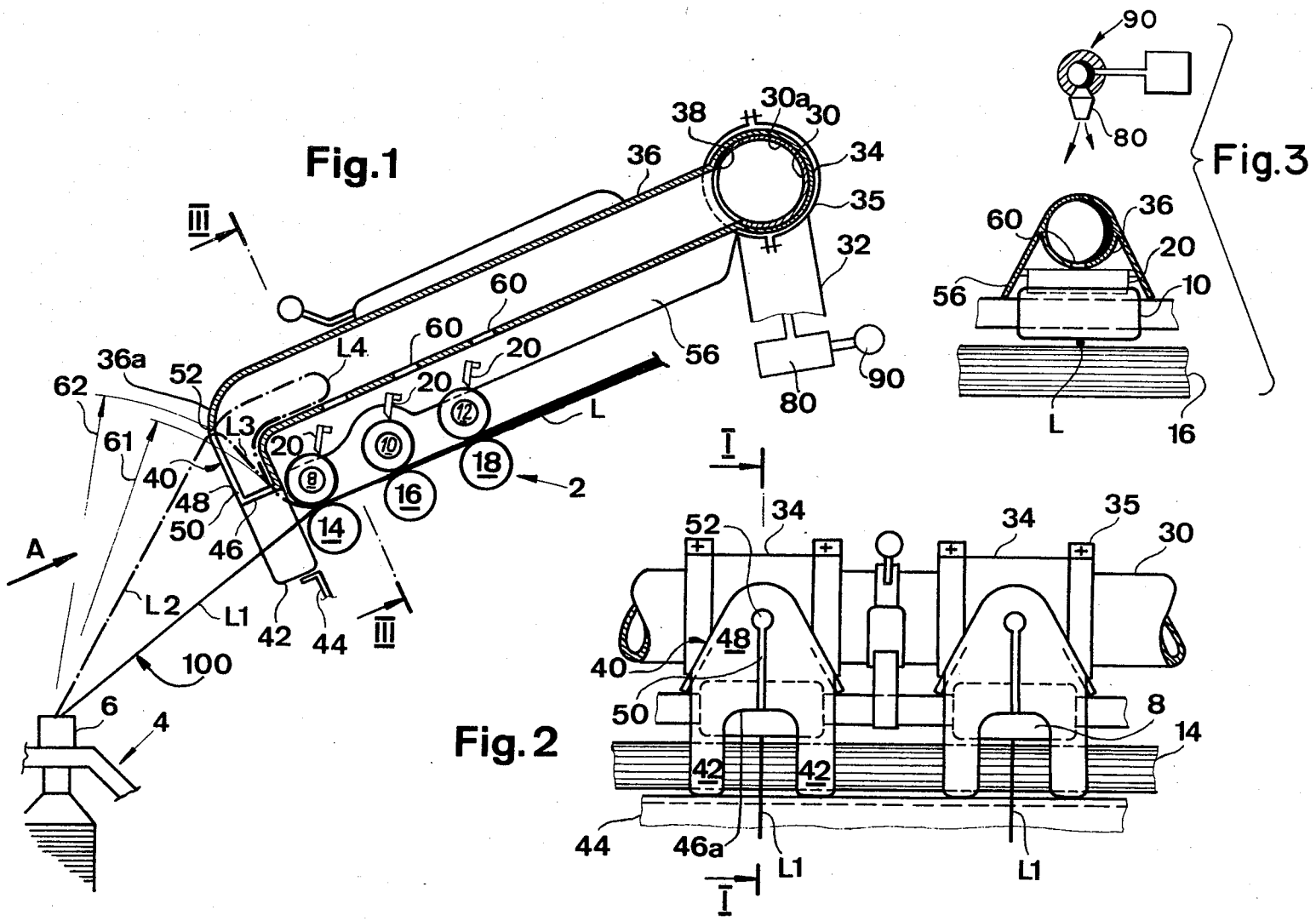
FIG. 1 is a schematic cross-sectional view of a broken end-collecting installation or apparatus constructed according to the teachings of the present invention, taken substantially along the line I—I of FIG. 2.
FIG. 2 is an end view of the arrangement of FIG. 1, looking in the direction of the arrow A.
FIG. 3 is a cross-sectional view of the apparatus of FIG. 1, taken substantially along the line III—III thereof.

Describing now the drawings, in FIG. 1 reference numeral 2 generally designates the drafting gear or drafting system of a flyer-spinning machine, by means of which there is drafted a slubbing L which travels to the head 6 of a flyer spindle 4. The upper rollers 8, 10 and 12 of the drafting system or drafting arrangement 2, and which cooperate with lower rollers 14, 16 and 18, respectively, are each provided with an associated stripper or scraper 20.

As best seen by referring to FIGS. 1 and 2, the broken end-collecting installation or apparatus of the present invention will be understood to comprise a suction channel 30 extending in the lengthwise direction of the machine and constructed as a substantially cylindrical tube or pipe. This suction channel 30 is operatively connected by means of a pipe connection 32 with a conventional and thus merely schematically illustrated filter box 80 of the textile machine. The filter box 80 is provided with, for instance, a vacuum pump 90 or other appropriate means providing an air pressure sink or itself may contain such structure therein, as is well known in this art. The suction channel 30 supports suction tubes or pipes 36 pivotably mounted thereon by means of the collars or sleeves 34 or equivalent structure, which are axially distributed in the lengthwise direction of the spindles 4 of the textile machine. These suction tubes or pipes 36 are rigidly connected with the collars 34 which carry clamping rings 35 and, furthermore, flow communicate by means of openings 38 provided in the channel wall 30*a* with the negative pressure source 90 provided in or at the filter box 80.

At their free ends 36*a* the suction tubes or pipes 36 are each provided with a respective downwardly flexed or bent end part or portion 40 constructed as or defining a suction head. Each such suction head 40 embodies two downwardly protruding screening legs 42 or equivalent structure, and by means of such screening legs engages past the path of travel $L_1$ of the slubbing or other filamentary material between the nip of the feed or delivery rollers 8 and 14 and the head 6 at the region of the so-called spinning triangle, generally indicated in FIG. 1 by reference character 100. By means of both screening legs 42 the free end of the suction tube 36 is supported in the operating position illustrated in FIGS. 1 and 2 at a screening rail 44. This screening rail 44 extends beneath the slubbing travel path $L_1$ in the lengthwise direction of the machine. The screening rail 44 in conjunction with the screening legs 42 limits a so-called quiescent zone which has a quieter air movement in relation to the air flow produced by the flyer-vanes, the so-called flyer wind. By providing such zone it is possible to reduce the frequency of rupture of the slubbing occurring in the spinning triangle 100 during operation.

At the wall portion 46*a* which bounds the underside 46 of the related suction head 40 between both of the screening legs 42 of such suction head 40, and also at the end wall thereof designated by reference character 48 there is formed a continuous substantially slot-shaped suction opening 50. The center line of such suction opening 50 is located in a vertical plane which at least approximately contains the slubbing travel path $L_1$ which usually move back-and-forth between certain end positions, and thus also contains the axis of the spindle 4. At the underside 46 the suction opening 50 extends up to the direct neighborhood of the upper feed roller 8, whereas its end located at the end wall 48 terminates in a substantially circular-shaped widened or enlarged portion 52 which is intersected by the lengthwise axis of the suction tube 36.

Operatively associated with the strippers 20 are the suction openings or holes 60 at the side of the suction tube 36 confronting such strippers 20, as best seen by referring to FIGS. 1 and 3, in order to continuously remove fiber and dust which collects at the strippers 20 during operation of the machine. On the other hand, the airflow which prevails at the suction holes 60 and especially the suction opening 50 is chosen such that the slubbing L is not damaged. In this regard the arrangement of the suction head 40 above the slubbing travel path is advantageous in contrast to an arrangement below the same. Since the slubbing L, frequently hangs down during the standstill times of the machine, there is not any danger upon start-up of the machine of damaging the slubbing due to the more rapidly effective suction airflow.

When there occurs rupture of the slugginb L within the spinning triangle 100 then the free end of the slubbing, which is further delivered by the drafting gear or drafting system 2, is seized by the air current directed towards the suction opening 50 in the zone which is protected by the screening elements or members 42 and 44. The slubbing end is thus positively sucked-up at the underside 46 into the suction opening 50 and transported by means of the suction head 40 into the suction tube or pipe 36. In the suction tube 36, under the action of the air current flowing to the collecting channel or connection 32 leading to the filter box 80, the slubbing L breaks up into fibers and fiber flocks.

If slubbing rupture occurs at the flyer-vanes, or the like, so that slubbing delivered by the drafting system 2 no longer can be drawn-in, the excess forming at the region of the path of travel $L_1$ of the slubbing L will be introduced, under the action of the suction air current, at the underside or lower face 46 into the suction opening 50. Together with the deflection of the slubbing L out of the travel path $L_1$ there also begins to form at such section a loop. Since at one leg of such loop there is further delivered slubbing L from the drafting gear or system 2, and, on the other hand, since the other leg is still connected with the head 6, the loop, after entering the suction head 40, progressively forms under the action of the air-flow directed towards the suction tube 36. Consequently, the loop leg or part connected with the head 6 experiences within the suction opening 50 a shifting or displacement action. As a result, the loop leg thus migrates from the suction opening part at the underside 46 into the part at the end surface or face 48, in order to thereafter finally reach the widened portion 52.

Upon reaching the widened or enlarged portion 52 the slubbing L extends from the spindle head 6 to the suction opening 50 approximately in the manner indicated by the phantom lines $L_2$ in the drawing of FIG. 1, whereas reference character $L_3$ schematically approximately represents the course of the slubbing from the widened portion 52 through the suction head 40 to the point of entry at the underside or lower face 46 at such point in time.

If further slubbing material is delivered by the drafting system 2, then the position $L_2$ of the slubbing L no longer changes. The new material which arrives from the drafting system 2, which, like the material along the path $L_3$, does not possess any twist, is transported into the interior of the suction tube 36, and only at this point in time can there be formed a loop with parallel legs, as indicated by reference character $L_4$.

Even if at this point in time the machine is not brought to standstill, there does not arise any clogging within the suction tube 36. On the one hand, the outflow of the slubbing material is not hindered by the formation or enlargement of the loop $L_4$. On the other hand, with more intensive penetration of the loop $L_4$ into the suction tube 36, especially at the region of the suction openings or holes 60, such loop breaks up into individual fibers or fiber bunches or the like, which can flow-off without causing any disturbance in the suction channel 30.

In conjunction with the clogging danger, particularly great for conventional suction installations at the entry into the suction tube, the system design illustrated in FIG. 1 also affords an improvement in that the spacing between the flyer head 6 and both ends of the suction opening 50 are not of the same size. As indicated by the radii 61 and 62, the spacing of the end of the flyer head 6 directed towards the widened portion 52 is greater than the spacing of that suction opening part where the slubbing L, deflected out of the travel path $L_1$ during slubbing rupture, initially enters. This means that during the displacement of the loop leg leading to the flyer head 6 into the position $L_2$ slubbing material, which yet still possesses twist, will be pulled out of the suction opening 50. Curling of the slubbing within the suction head 40 is therefore practically precluded.

In the event that the machine is equipped with a cleaning device, where there are provided above the drafting gears or systems downwardly directed blower nozzles 80 which may be stationary or traveling on a blower means, generally indicated by reference character 90 in FIG. 3, it is advantageous to screen the path of the slubbing through the drafting system or gear by means of not particularly illustrated slubbing guides. As such has been indicated in FIGS. 1 and 3, this can be accomplished by the provision of a substantially roof-shaped hood or hood member 56 formed of one-piece with the respective associated suction tube or pipe 36 and together therewith can be rocked or pivoted upwardly about the axis of the suction channel 30, in order to render possible the start-up of the spinning operation. Due to the upward pivoting of the suction tube out of the illustrated position, the associated opening 38 in the channel, depending upon its construction, can be blocked in known manner and there can be interrupted the suction flow in such tube.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A broken-end collecting installation for the drafting gears of spinning machines, each defining gear having cooperating upper and lower rollers, including at least one pair of feed rollers defining a spinning triangle, through which fiber material passes on to guide means of a twisting head comprising:

a suction head provided for each drafting gear;

means defining an air pressure sink operatively connected with said suction head;

said suction head incorporating a substantially slot-shaped suction opening operatively associated with the feed rollers of the related drafting gear;

said slot-shaped suction opening extending from a first end thereof situated closer to the spinning triangle to a second end thereof situated closer to the air pressure sink in the flow direction of the air;

said slot-shaped suction opening also extending in a direction with respect to said flow direction whereby said second end is transversely spaced from said first end, whereby upon rupture of the fiber material at a location subsequent to the guide means the fiber material extending to the guide means is induced to be sucked towards said second end and further delivered fiber material passes into the suction opening adjacent said first end.

2. The installation as defined in claim 1, wherein:

the distance between a predetermined part of the spinning machine and the end of the suction opening removing from the spinning triangle is greater than the distance to the closer situated end.

3. The installation as defined in claim 2, wherein:

said part of the spinning machine comprises a flyer head.

4. The installation as defined in claim 1, wherein:

said part of the spinning machine comprises a yarn guide.

5. The installation as defined in claim 1, wherein:

said suction opening narrows between its two ends.

6. The installation as defined in claim 1, wherein:

the suction opening has a center line which extends approximately in a plane containing the path of travel of the yarn.

7. The installation as defined in claim 1, wherein:

said suction opening extends into two surfaces which enclose a predetermined angle with one another.

8. The installation as defined in claim 1, wherein:

there is provided a respective suction tube for each drafting gear;

each said suction tube extending approximately transversely with respect to the axes of the rollers of the drafting gear;

each said suction tube having an end part forming one said suction head and extending at a predetermined angle with respect to the lengthwise axis of the suction tube;

the second end of the suction opening of each suction head situated closer to the air pressure sink protruding into the axial projection of the related suction tube.

9. The installation as defined in claim 8, wherein:

the lengthwise axis of the suction tube extends in a substantially vertical plane approximately containing the path of travel of the yarn.

10. The installation as defined in claim 8, wherein:

the suction opening extends in two surfaces which enclose a predetermined angle with one another;

said suction opening processing a section arranged at an under face of said suction head and defining a first of said two surfaces and a section arranged at an end face of the suction head defining the second of said two surfaces.

11. A broken end-collecting installation for the drafting gears of spinning machines for spinning a yarn moving through a spinning triangle, each drafting gear having cooperating upper and lower rollers, including at least one feed roller, comprising:

a suction head provided for each drafting gear;

means defining an air pressure sink operatively connected with said suction head;

said suction head incorporating a substantially slot-shaped suction opening operatively associated with the feed roller of the related drafting gears;

said slot-shaped suction opening extending from an end thereof situated closer to the spinning triangle to an end thereof situated closer to the air pressure sink in the flow direction of the air;

a respective suction tube for each drafting gear;

each said suction tube extending approximately transversely with respect to the axes of the rollers of the drafting gear;

each said suction tube having an end part forming one said suction head and extending at a predetermined angle with respect to the lengthwise axis of the suction tube;

the end of the suction opening of each suction head situated closer to the air pressure sink protruding into the axial projection of the related suction tube;

the suction tube possesses suction openings confronting the drafting gear-rollers; and stripper means provided for the upper rollers of the drafting gear operatively associated with said suction openings.

12. A broken end-collecting installation for the drafting gears of spinning machines for spinning a yarn moving through a spinning triangle, each drafting gear having cooperating upper and lower rollers, including at least one feed roller, comprising:

a suction head provided for each drafting gear;

means defining an air pressure sink operatively connected with said suction head;

said suction head incorporating a substantially slot-shaped suction opening operatively associated with the feed roller of the related drafting gear;

said slot-shaped suction opening extending from an end thereof situated closer to the spinning triangle to an end thereof situated closer to the air pressure sink in the flow direction of the air;

a respective suction tube for each drafting gear;

each said suction tube extending approximately transversely with respect to the axes of the rollers of the drafting gear;

each said suction tube having an end part forming one said suction head and extending at a predetermined angle with respect to the lengthwise axis of the suction tube;

the end of the suction opening of each suction head situated closer to the air pressure sink protruding into the axial projection of the related suction tube;

the suction tubes extend above the drafting gears of the machine;

a common suction channel extending in the lengthwise direction of the machine with which there are connected the suction tubes;

means pivotably mounting each suction head together with the related suction tube about an axis extending approximately parallel to the suction channel and between a work position and a spinning start-up position.

13. The installation as defined in claim 12, wherein:

each suction head is provided with screening legs engaging in a straddling gantry-like fashion over the yarn path of travel.

14. The installation as defined in claim 13, further including:

screening rail means extending below the yarn path of travel in the lengthwise direction of the machine against which bear by means of said screening legs the suction heads in the work position.

15. The installation as defined in claim 12, wherein:

each suction tube in its spinning start-up position interrupts the connection between the suction tube and the suction channel.

16. The installation as defined in claim 12, wherein:

said pivotably mounting means serves to pivotably mount the suction tube directly at the suction channel; and said suction channel possessing a substantially circular cross-sectional configuration.

17. A broken end-collecting installation for the drafting gears of spinning machines for spinning a yarn moving through a spinning triangle, each drafting gear having cooperating upper and lower rollers, including at least one feed roller, comprising:

a suction head provided for each drafting gear;

means defining an air pressure sink operatively connected with said suction head;

said suction head incorporating a substantially slot-shaped suction opening operatively associated with the feed roller of the related drafting gear;

said slot-shaped suction opening extending from an end thereof situated closer to the spinning triangle to an end thereof situated closer to the air pressure sink in the flow direction of the air;

a respective suction tube for each drafting gear;

each said suction tube extending approximately transversely with respect to the axes of the rollers of the drafting gear;

each said suction tube having an end part forming one said suction head and extending at a predetermined angle with respect to the lengthwise axis of the suction tube;

the end of the suction opening of each suction head situated closer to the air pressure sink protruding into the axial projection of the related suction tube;

blower means arranged above the suction tubes at the machine;

said blower means including at least one blower nozzle;

each suction tube supporting a substantially roof-shaped screening element covering the yarn path of travel and extending up to the suction head.

18. A broken end-collecting installation for the drafting arrangements of spinning machines from which fiber material passes on to guide means of a twisting device, comprising:

a suction head provided for each drafting arrangement;

means defining an air pressure sink with which there is operatively connected each said suction head;

each said suction head having a substantially slot-shaped suction opening capable of being operatively associated with a feed roller of its related drafting arrangement;

said substantially slot-shaped suction opening imparting to a ruptured yarn piece leading to a rupture location following the guide means of the twisting device a different position than the path of travel of fiber material which is further delivered from the drafting arrangement.

19. A method of preventing clogging of a suction head of a broken end-collecting installation for the drafting gears of spinning machines through which fiber material passes on to guide means of a twisting device, comprising the steps of:

imparting to a ruptured yarn piece leading to a rupture location past the guide means of the twisting device a different position than the path of travel of the fiber material which is further delivered from the drafting gear.

20. The method as defined in claim 19, wherein:

the step of imparting a different position to the ruptured yarn piece is accomplished with the aid of a substantially slot-shaped suction opening of a suction head.

* * * * *